US005335906A

United States Patent [19]

Delker

[11] Patent Number: 5,335,906

[45] Date of Patent: Aug. 9, 1994

[54] DUMMY APPARATUS FOR FOOTBALL PRACTICE

[76] Inventor: Charles L. Delker, 6135 S. Chanticleer Dr., Maumee, Ohio 43537

[21] Appl. No.: 916,177

[22] Filed: Jul. 17, 1992

[51] Int. Cl.[5] ..... A63B 67/00

[52] U.S. Cl. ..... 273/55 A

[58] Field of Search ..... 273/55 R, 55 A; 446/901, 369, 226, 273, 325, 220

[56] References Cited

U.S. PATENT DOCUMENTS

| | | | |
|---|---|---|---|
| 596,109 | 12/1897 | Gedney | 446/291 |
| 1,663,659 | 3/1928 | Hart et al. | 273/55 A |
| 1,906,693 | 5/1933 | Loughlin | 273/55 A |
| 2,632,977 | 3/1953 | Valasek | 273/55 A |
| 2,937,872 | 5/1960 | Gilman | 273/55 A |
| 3,384,372 | 5/1968 | Dickens | 273/55 A |
| 3,391,936 | 7/1968 | Rrimes | 273/55 A |
| 3,558,135 | 1/1971 | Rees | 273/55 A |
| 3,573,867 | 4/1971 | Mehrens | 273/55 A |
| 3,907,291 | 9/1975 | Parker | 273/55 A |
| 4,824,414 | 4/1989 | Goldblatt | 273/55 A |

FOREIGN PATENT DOCUMENTS 2209988 9/1973 Fed. Rep. of Germany .... 273/55 R

OTHER PUBLICATIONS

Marty Gilman, Inc., Catalog, 1991, pp. 5, 17, 18.
Rae Crowther Co., Catalog, 1991.
Rogers Athletic Company, Catalog, 1991, pp. 12, 13, 18.

*Primary Examiner*—Theatrice Brown
*Attorney, Agent, or Firm*—Howard & Howard

[57] ABSTRACT

A dummy apparatus for practicing football techniques includes a generally upright, ground engaging, hollow inflatable body and an arm having an upper end attached to the body and an opposite end. The arm has an upper arm portion extending generally vertically from the upper end to an elbow and a forearm portion extending generally horizontally from the elbow to the free end whereby a human football carrier is simulated for practicing football techniques. A valve is attached to the body for inflating and deflating the dummy. A fastener includes a first fastener portion attached to the forearm portion of the arm and a second fastener portion for attaching to a football, the first and second fastener portions being formed of loop and hook materials respectively and being releasably connected together.

8 Claims, 1 Drawing Sheet

DUMMY APPARATUS FOR FOOTBALL PRACTICE

BACKGROUND OF THE INVENTION

The present invention relates generally to an apparatus for practicing the game of football and, in particular, to a dummy apparatus for permitting football players to practice causing fumbles by ball carriers.

The nature of the contact sport of football is such that injuries occur even during practice. Therefore, it is desirable to practice against inanimate objects rather than teammates. For example, sleds are available for assisting players to develop proper offensive blocking skills. These sleds typically have pads attached to a framework mounted on ground engaging skids. The sleds also can be used to develop tackling, drive blocking, pass protection and hit-and-spin skills.

Various types of dummies also are available for practicing football techniques. While some dummies are designed to hang from a frame, other dummies are free-standing. Typically, the free-standing dummies are used to teach blocking and tackling techniques. In some cases, the dummies are of the pop-up type which frees a player from having to hold the dummy while another player practices. Pop-up dummies are generally air filled with a rounded, weighted bottom. Most pop-up dummies are provided with handles and at least one version has two horizontally extending arms to simulate a blocker with his arms fully extended.

Currently, defensive football players are being taught to be alert to an opportunity to cause a fumble by a ball carrier. Although the most important concern is to stop the forward motion of the ball carrier, the first tackler or a subsequent tackler may be presented with the opportunity to "tackle" or "strip" the ball causing the ball carrier to lose his grip and fumble. Currently, the only method of practicing this defensive technique is to use a teammate as the ball carrier.

SUMMARY OF THE INVENTION

The present invention concerns a dummy apparatus for practicing football techniques. The dummy is of the pop-up type which permits its use for practicing blocking and tackling techniques. However, the dummy is also provided with a bent arm and means for retaining a football to enable players to practice "tackling" or "stripping" the ball.

The dummy is formed with a generally "pear-shaped" body. The body is inflatable and has a rounded and weighted bottom causing the dummy to stand straight up and to automatically pop back up when knocked down. Extending from the body is an arm formed with a bend at the elbow to simulate the classic position for carrying a football while running. A releasable fastener, such as a loop and hook type material, is used to position and hold the football between the forearm and the dummy body. The fastener simulates the degree of retention a human ball carrier would exhibit and permits the ball to be dislodged by a properly executed tackle.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
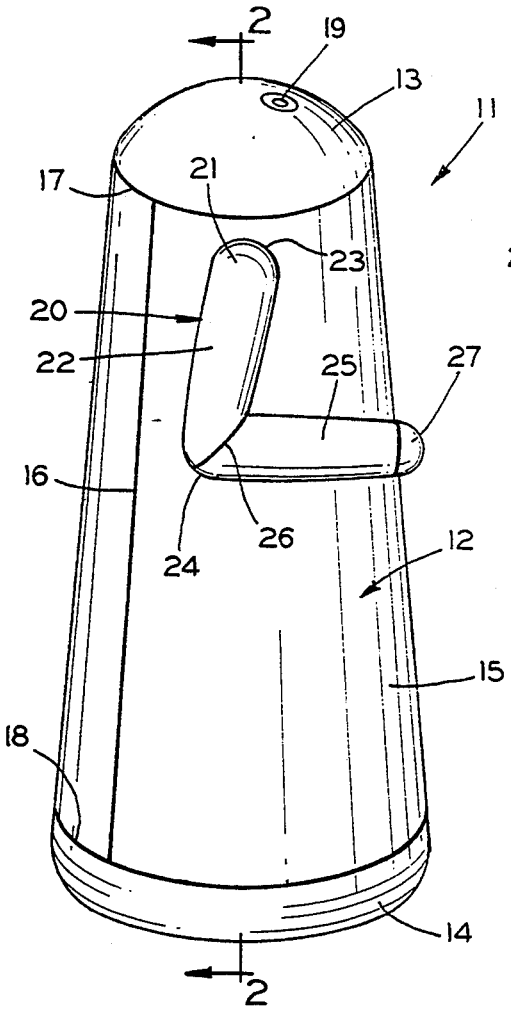
FIG. 1 is a side elevation view of a dummy apparatus in accordance with the present invention.

There is shown in the FIG. 1 a football practice dummy 11 having a generally pear-shaped body 12 being smaller in diameter at a rounded upper end 13 and larger in diameter at a rounded lower end 14. Typically, the body 12 is formed from a nylon material which can have a coated interior surface to prevent air from escaping. As shown, a central portion 15 of the body 12 can be formed in a generally cylindrical shape with a vertically extending seam 16 and open upper and lower ends. The upper end portion 13 is joined to the central portion 15 at a seam 17 and the lower end portion 14 is joined to the body 12 at a seam 18 to form an air tight structure. A valve 19 can be provided in the upper end portion 13 for inflating and deflating the dummy typically from a source of compressed air.

An arm structure 20 has an upper end 21 attached to an upper portion of the body 12 below the seam 17. The arm structure 20 includes an upper arm portion 22 having the upper end 21 attached to the central portion 15 of the body by a seam 23 and extending generally vertically downwardly to an elbow 24. A generally horizontally extending forearm portion 25 has one end attached to the lower end of the upper arm portion by a seam 26 at the elbow 24. The forearm extends from the elbow 24 and terminates at a free end 27.

Figure 2:
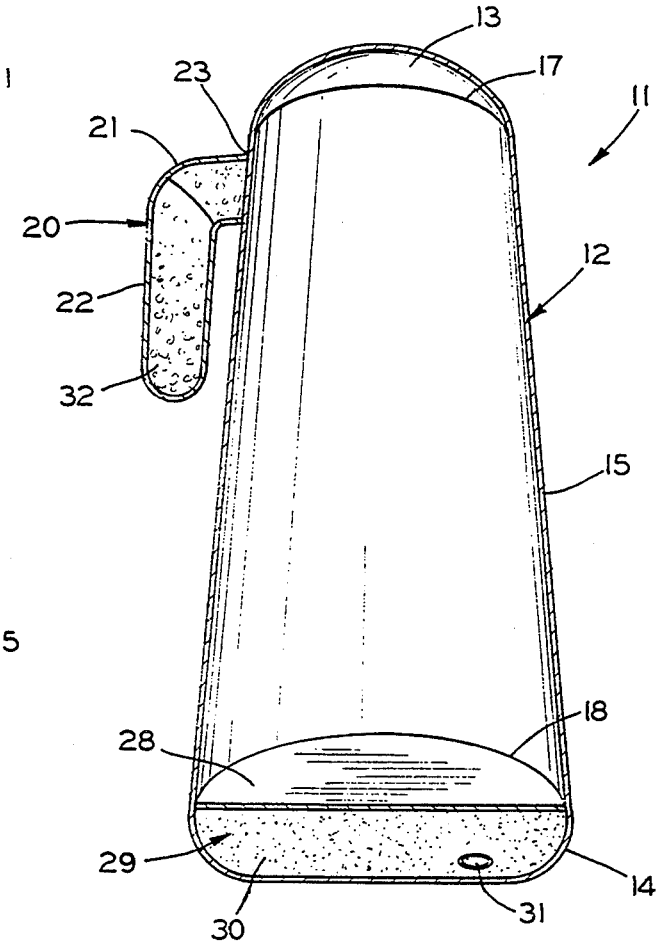
FIG. 2 is cross-sectional view of the dummy apparatus taken along the line 2—2 in the FIG. 1.

The FIG. 2 is a cross-sectional view of the dummy 11 showing the hollow interior of the body 12. The lower end portion 14 can be weighted to assist the body 12 to maintain an upright position. For example, an internal wall 28 can be attached at the seam 18 to form a cavity 29 at the bottom of the body 12. The cavity 29 can be filled with any suitable ballast material 30 such as sand to provide a weighted base. If it is desired to repeatedly fill and empty the cavity 29, a closable filler opening 31 can be provided in the lower end portion 14. The arm 20 can be hollow and open to the interior of the body 12 at the seam 23 to be inflated, or can be filled with a suitable material 32 such as foam similar to that used as packing in cardboard boxes.

Figure 3:
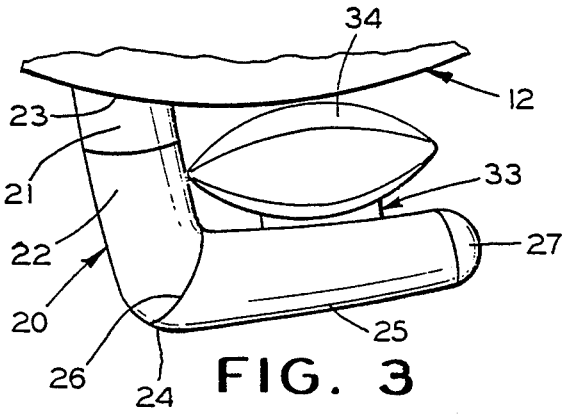
FIG. 3 is an enlarged fragmentary top plan view of the arm of the dummy apparatus shown in the FIG. 1 retaining a football.
Figure 4:
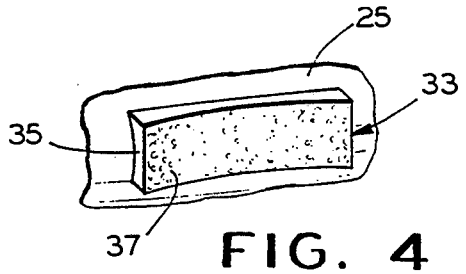
FIG. 4 is an enlarged fragmentary side elevation view of the arm and a first fastener portion shown in the FIG. 3.
Figure 5:
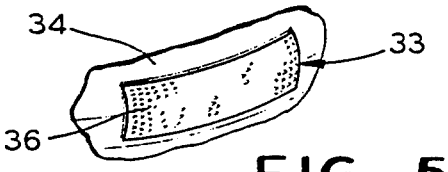
FIG. 5 is an enlarged side elevation view of the football and a second fastener portion shown in the FIG. 3.

As shown in the FIGS. 3 through 5, a releasable fastener means 33 is provided to attach a football 34 to the forearm portion 25 of the arm 20. The fastener 33 includes a first fastener portion 35 attached to the forearm 25 extending in a generally horizontal direction and facing the body 12, and a cooperating second fastener portion 36 attached to the football 34. The first fastener portion 35 has a generally concave attachment surface 37 which is contoured to substantially to match the shape of a center portion of the football 34 when a longitudinal axis of the football is generally parallel to a longitudinal axis of the forearm 25. The second fastener portion 36 is attached to and contoured to a central portion of the football. The fastener portions 35 and 36 can be formed of any suitable materials which permit the football 34 to be releasably attached to the forearm 25. For example, the first fastener portion 35 can be formed of a loop material having a plurality of loops formed on the attachment surface 37 and the second fastener portion 36 can be formed of a hook material having a plurality of cooperating hooks thereon. When the second fastener portion 36 is brought into contact with the attachment surface 37, many of the hooks engage many of the loops and the football 34 is held in the position shown in the FIG. 3.

During football practice, the dummy 11 can be utilized as a conventional pop-up type blocking and tackling dummy. However, when the football 34 is attached in the position shown in the FIG. 3, the dummy 11 can be used to practice "tackling" or "stripping" the ball. Generally, "tackling" the ball involves placing both hands on the football and pulling the ball away from the ball carrier. This technique is usually utilized by the second or a subsequent defensive player to reach the ball carrier who is being tackled by a first defensive player. "Stripping" the ball usually involves hitting the ball with one hand, typically in a downward motion of the arm, in an attempt to loosen and free the football from the ball carrier's grip. The materials for the fastener 33 are selected to provide a degree of holding the football 34 which simulates the grip of a human ball carrier.

Figure 6:
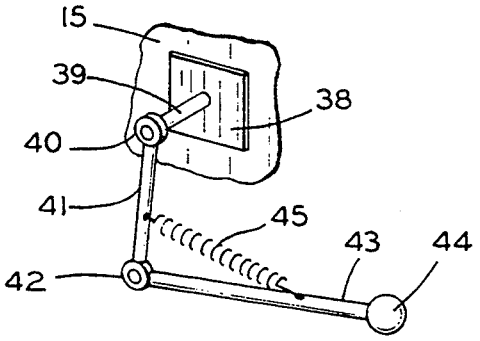
FIG. 6 is a perspective view of an alternate embodiment arm structure for the dummy apparatus shown in the FIG. 1.

There is shown in the FIG. 6, an alternate structure for the arm structure 20 shown in the FIGS. 1-3. As described above, the arm structure 20 can be inflated with air or can be filled with a foam material 32. The characteristics of the foam material can be selected to provide some predetermined degree of resistance to moving the arm structure from the position shown in the FIG. 1 when a defensive football player grasps the arm structure in an attempt to cause a fumble. If additional resistance is desired to more closely simulate a ball carrier attempting to maintain his arm position and retain the football, a linkage can be located inside the arm structure 20.

The linkage includes a mounting plate 38 which is attached to the central portion 15 of the body 12 where the upper end 21 of the arm structure 20 joins the material forming the central portion 15. Extending generally horizontally outwardly from the plate 38 is a shoulder post 39 having a shoulder joint 40 attached to an outer end thereof. Extending downwardly from the joint 40 is an upper arm link 41 having an elbow joint 42 attached to a lower end thereof. Extending generally horizontally from the elbow joint 42 is a forearm link 43 having a padded ball attached to a free end thereof. The padded ball 44 is located inside the free end 27 of the forearm portion 25. The joints 40 and 42 can be constructed to provide a desired degree of resistance to movement of the links 41 and 43 respectively. Also, springs can be utilized to provide resistance to movement and return the links to the position shown in the FIG. 6. For example, a spring 45 has one end attached to the link 41 and an opposite end attached to the link 43 for resisting rotation of the forearm link 43 about the elbow joint 42 and for returning the link 43 to the resting position.

In summary, the present invention concerns a dummy apparatus for practicing football techniques including a generally upright, ground engaging, hollow inflatable body and an arm having an upper end attached to the body and an opposite end. The arm has an upper arm portion extending generally vertically from the upper end to an elbow and a forearm portion extending generally horizontally from the elbow to the free end whereby a human football carrier is simulated for practicing football techniques. A valve is attached to the body for inflating and deflating the dummy. A fastener includes a first fastener portion attached to the forearm portion of the arm and a second fastener portion for attaching to a football, the first and second fastener portions being formed of loop and hook materials respectively and being releasably connected together.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A dummy apparatus for practicing football techniques comprising:

a generally upright ground engaging body;

an arm having an upper end attached by attachment means to an upper region of said body and an opposite free end, said arm being hollow and including an arm linkage extending through the interior of said arm, said attachment means being a mounting plate attached to the exterior surface of said body, said one end of said arm linkage being attached to said mounting plate, said arm linkage includes a shoulder post connected between said mounting plate and a shoulder joint, an upper arm link connected between said shoulder joint and an elbow joint, and a forearm link having one end connected to said elbow joint and its other end being said opposite free end of said arm, said upper arm link extending generally vertically downward from said shoulder post to said elbow joint and a forearm portion extending generally horizontally forward from said elbow to said opposite free end adjacent to said body; and fastener means for releasably retaining a football between said body and said forearm portion of said arm, said fastener means including a first fastener portion attached to said forearm portion of said arm facing said body and a second fastener portion for attaching to a football and being releasably attached to said first fastener portion with a preselected degree of holding whereby a grip of a human football carrier is simulated for practicing football techniques.

2. The dummy apparatus according to claim 1 wherein said body is hollow and including a valve attached to said body for inflating and deflating said body.

3. The dummy apparatus according to claim 1 wherein said arm is filled with a foam material.

4. The dummy apparatus according to claim 1 including a cavity formed in a lower end of said body and a ballast material in said cavity.

5. The dummy apparatus according to claim 1 wherein said first fastener portion has a generally concave attachment surface and said second fastener portion conforms to a shape of an exterior surface of a football.

6. The dummy apparatus according to claim 1 wherein said first fastener portion is formed of a loop material and said second fastener portion is formed of a hook material.

7. The dummy apparatus according to claim 1 including a spring connected between said upper arm link and said forearm link for resisting movement of said forearm link about said elbow joint in a downward direction.

8. A dummy apparatus for practicing football techniques comprising:

a generally upright ground engaging body;

an arm having an upper end attached by attachment means to an upper region of said body and an opposite free end, said arm being hollow and has an arm linkage extending through the interior of said arm, said attachment means being a mounting plate attached to the exterior surface of said body, said one end of said arm linkage being attached to said mounting plate, said arm linkage includes a shoulder post connected between said mounting plate and a shoulder joint, an upper arm link connected between said shoulder joint and an elbow joint and a forearm link having one end connected to said elbow joint and its other end other end being said opposite free end of said arm, said upper arm link extending generally vertically downward from said shoulder post to said elbow joint and a forearm portion extending generally horizontally forward from said elbow to said opposite free end adjacent to said body;

a football; and a fastener means having a first fastener portion attached to said forearm portion facing said body and a second fastener portion attached to said football, said second fastener portion being releasably connected to said first fastener portion for releasably attaching said football to said forearm portion with a preselected degree of holding and positioning said football between said forearm portion and said body whereby a grip of a human football carrier is simulated for practicing football techniques.

* * * * *